US008316604B2

(12) United States Patent
Thiers

(10) Patent No.: US 8,316,604 B2
(45) Date of Patent: Nov. 27, 2012

(54) FLOOR PANEL AND METHOD FOR MANUFACTURING SUCH FLOOR PANEL

(75) Inventor: Bernard Thiers, Oostrozebeke (BE)

(73) Assignee: Flooring Industries Limited, SARL, Bertrange (LU)

( * ) Notice: Subject to any disclaimer, the term of this patent is extended or adjusted under 35 U.S.C. 154(b) by 237 days.

(21) Appl. No.: 12/086,645

(22) PCT Filed: Dec. 15, 2006

(86) PCT No.: PCT/IB2006/003735

§ 371 (c)(1),
(2), (4) Date: Jun. 17, 2008

(87) PCT Pub. No.: WO2007/072198

PCT Pub. Date: Jun. 28, 2007

(65) Prior Publication Data

US 2009/0260307 A1 Oct. 22, 2009

(30) Foreign Application Priority Data

Dec. 23, 2005 (BE) ..... 2005/0620

(51) Int. Cl.
*B44F 7/00* (2006.01)

(52) U.S. Cl. ..... 52/314; 52/313; 52/555; 52/578; 428/172

(58) Field of Classification Search ..... 52/390, 52/311.1, 313, 314, 316, 392, 554, 555, 578, 52/782.1; 428/203, 172, 204
See application file for complete search history.

(56) References Cited

U.S. PATENT DOCUMENTS

| | | | | | |
|---|---|---|---|---|---|
| 1,934,792 | A | * | 11/1933 | Chaffee | 52/314 |
| 2,108,226 | A | | 2/1938 | Johnston | |
| 3,796,586 | A | * | 3/1974 | Hanlon | 428/151 |
| 3,826,054 | A | * | 7/1974 | Culpepper, Jr. | 52/309.8 |
| 4,131,705 | A | | 12/1978 | Kubinsky | |
| 4,188,762 | A | * | 2/1980 | Tellman | 52/541 |
| 4,266,382 | A | * | 5/1981 | Tellman | 52/316 |
| 4,290,248 | A | * | 9/1981 | Kemerer et al. | 52/309.16 |
| 4,598,522 | A | * | 7/1986 | Hoofe, III | 52/555 |
| 5,283,102 | A | * | 2/1994 | Sweet et al. | 428/167 |
| 5,284,693 | A | * | 2/1994 | Spain et al. | 428/172 |
| 5,506,031 | A | * | 4/1996 | Spain et al. | 428/172 |
| 5,540,026 | A | * | 7/1996 | Gartland | 52/455 |
| 5,662,977 | A | * | 9/1997 | Spain et al. | 428/42.1 |
| D410,095 | S | * | 5/1999 | Hedges et al. | D25/143 |
| 5,927,044 | A | * | 7/1999 | Lamb et al. | 52/745.19 |
| 6,103,160 | A | * | 8/2000 | Uchida et al. | 264/113 |

(Continued)

FOREIGN PATENT DOCUMENTS

JP 2001-90326 * 4/2001

(Continued)

*Primary Examiner* — Brian Glessner
*Assistant Examiner* — Brent W Herring
(74) *Attorney, Agent, or Firm* — Bacon & Thomas, PLLC

(57) ABSTRACT

Floor panel, said floor panel (1) comprising a decor (2), as well as a top layer (8) based on synthetic material (9), and wherein the decor (2) represents a pattern with several wood parts (3) per floor panel (1), characterized in that in the upper surface (14) of the floor panel (1) one or more height differences are present in that the upper surface (14), at the location of one of more of the wood parts (3), shows an individualized global surface level (16).

19 Claims, 13 Drawing Sheets

U.S. PATENT DOCUMENTS

| | | | | |
|---|---|---|---|---|
| 6,194,055 | B1 * | 2/2001 | Eichhorn | 428/167 |
| 6,197,405 | B1 * | 3/2001 | Johnsen et al. | 428/195.1 |
| 6,237,294 | B1 * | 5/2001 | Rygiel | 52/314 |
| 6,326,074 | B1 * | 12/2001 | Takahashi | 428/156 |
| 6,336,303 | B1 * | 1/2002 | Vandeman et al. | 52/520 |
| 6,401,415 | B1 * | 6/2002 | Garcia | 52/311.1 |
| 6,634,617 | B2 * | 10/2003 | Potvin | 249/16 |
| 6,688,061 | B2 * | 2/2004 | Garcia | 52/311.1 |
| 6,691,480 | B2 * | 2/2004 | Garcia | 52/313 |
| 6,952,903 | B2 * | 10/2005 | West et al. | 52/455 |
| 7,055,290 | B2 * | 6/2006 | Thiers | 52/592.2 |
| 7,081,300 | B2 * | 7/2006 | Laurence et al. | 428/423.7 |
| 7,249,445 | B2 * | 7/2007 | Thiers | 52/592.1 |
| 7,367,166 | B2 * | 5/2008 | Luetgert et al. | 52/313 |
| 7,527,852 | B2 * | 5/2009 | Sigel et al. | 428/212 |
| 7,632,561 | B2 * | 12/2009 | Thiers | 428/151 |
| 7,897,228 | B2 * | 3/2011 | Steinhardt et al. | 428/40.1 |
| 2002/0100231 | A1 * | 8/2002 | Miller et al. | 52/177 |
| 2002/0189183 | A1 * | 12/2002 | Ricciardelli | 52/390 |
| 2003/0072919 | A1 * | 4/2003 | Watts et al. | 428/159 |
| 2004/0219334 | A1 * | 11/2004 | Watts et al. | 428/160 |
| 2006/0144004 | A1 * | 7/2006 | Nollet et al. | 52/578 |
| 2006/0156672 | A1 * | 7/2006 | Laurent et al. | 52/589.1 |
| 2006/0191222 | A1 * | 8/2006 | Sabater et al. | 52/311.2 |
| 2008/0178550 | A1 * | 7/2008 | Pierzynski et al. | 52/554 |
| 2008/0286537 | A1 * | 11/2008 | Lefaux et al. | 428/203 |
| 2009/0056257 | A1 * | 3/2009 | Mollinger et al. | 52/314 |
| 2009/0078129 | A1 * | 3/2009 | Cappelle et al. | 100/35 |
| 2009/0252925 | A1 * | 10/2009 | Provoost et al. | 428/151 |

FOREIGN PATENT DOCUMENTS

| | | | |
|---|---|---|---|
| WO | WO 97/47834 | | 12/1997 |
| WO | WO 01/47718 | A1 | 7/2001 |
| WO | WO 01/96688 | A1 | 12/2001 |
| WO | WO 01/96689 | A1 | 12/2001 |
| WO | WO 01/98603 | A2 | 12/2001 |
| WO | WO 2004/067874 | A2 | 8/2004 |
| WO | WO 2004/108436 | A2 | 12/2004 |
| WO | WO 2005/046987 | A1 | 5/2005 |

* cited by examiner

FLOOR PANEL AND METHOD FOR MANUFACTURING SUCH FLOOR PANEL

BACKGROUND

A. Field

This invention relates to a floor panel, more particularly a laminate floor panel, as well as to a method for manufacturing such floor panel. Moreover, it also relates to floor coverings composed of such floor panels.

B. Related Art

In particular it relates to a floor panel of the type intended for forming a floating floor covering, wherein this floor panel comprises a decor, preferably a printed decor, as well as a top layer based on synthetic material, and wherein the decor of the floor panel represents a pattern with one or several wood parts.

From the state of the art, various means are known for providing the upper surface of such floor panels with a structure that renders an imitation of wood or wood parts more realistic. A first means consists in realizing impressions imitating wood structure or wood pores in the top layer of these floor panels, as is known, for example, from WO 01/96689. A second means consists in realizing imitation chamfers, either on the edge of the floor panel, or in the upper surface of the floor panel between the wood parts represented in the decor. Such imitation chamfers may be performed at the edge of the floor panel, for example, as a beveled edge, as is known as such from WO 01/96688.

However, the above-described means are insufficient for realizing, for example, a floor panel representing several wood parts in a realistic manner, or for realizing floor panels that have to render an antique impression.

The floor panels known up to now, which represent several wood parts, indeed still show a number of disadvantages, even when the aforementioned means are integrated therein. So, for example, do disadvantageous effects appear when a user observes a floor covering composed of such floor panels from a distance and/or under a relatively acute angle. In such a situation, the user will observe the decor not at all or less and, on the one hand, when solely the aforementioned first means has been applied, will not be able to observe that the floor panel represents several wood parts, however, on the contrary will obtain the impression of a completely flat surface in which a wood structure is present, or, on the other hand, when the second means is applied, will indeed be able to observe that the floor panel represents several wood parts, however, will have a strongly artificial impression thereof, as each wood part is surrounded by imitation chamfers in completely the same manner.

SUMMARY OF THE INVENTION

According to its first aspect, the present invention concerns a floor panel, which, at its upper surface, is provided with a structure that offers various new possibilities for imitating in a realistic manner, amongst others, so-called multiplank or strip parquet, parquet tiles, antique parquetry, and the like. To this aim, the invention, according to a first aspect, relates to a floor panel, wherein this floor panel comprises a decor, as well as a top layer based on synthetic material, and wherein the decor represents a pattern with several wood parts per floor panel, with as a characteristic that in the upper surface of the floor panel one or more height differences are present in that the upper surface, at the location of one of more of the wood parts, shows an individualized global surface level.

By "global surface level", here the level of the upper surface of the floor panel or a portion of this upper surface is meant, without accounting for height differences as a result of possible local impressions, such as imitation chamfers and impressions imitating wood structure. By "individualized global surface level" is meant that the upper surface of the floor panel, at the location of a wood part, shows a global surface level with height differences that is adapted to this wood part and/or that the upper surface of the floor panel at the location of a wood part, in other words, the global surface level of a wood part, is made such that a height difference is created at least in respect to the global surface level of an adjacent wood part. Expressed otherwise, by an "individualized global surface level" is meant that one or more segments of the surface, which correspond to wood parts, have a typical own global surface profile, by which, as will be explained further, is meant that the surfaces of these segments each are made, for example, with an own inclination, an own curvature, an own height and the like.

As the invention, according to its first aspect, provides for the realization of height differences by providing individualized global surface levels, it is obtained that a floor covering, which is composed of such floor panels, renders a more natural impression. For a user looking at such floor panels in a floor covering from a distance, the wood parts will be delineated, among others, by the presence of the aforementioned height differences. Preferably, at the location of each wood part such individualized global surface level is applied. It is clear that in this case the most realistic impression of the floor panel, the floor covering, respectively, can be obtained.

Such individualized global surface levels can be realized in various manners. Preferably, the individualized surface levels are realized by means of at least one of the following possibilities:

- in that at the location of the respective represented wood part the respective surface as a whole is situated higher or lower than the surface at the location of one or more adjacent represented wood parts;
- in that at the location of the respective represented wood part the respective surface is at least partially inclined in respect to the general upper surface of the floor panel;
- in that at the location of the respective represented wood part the respective surface is made with a curvature, more particularly is concave or convex;
- in that at the location of the respective represented wood part the respective surface, in the direction of an edge or corner, is made deeper in a sloping manner in respect to the adjacent surface.

In the case that in the above possibilities an inclined portion, such as a concave or convex portion or an inclined portion, is applied, it is obtained that incident light on the respective surface is reflected or refracted in another manner, more particularly preferentially under other angles, than on the surface adjacent to this portion. Hereby, a user, even when the decor is not visible or less visible, will be able to recognize this portion from a distance as a portion of a wood part and will experience the floor covering as a whole as less artificial.

It is noted that the presence of inclined portions in the global individualized surface level also gives the impression of antique parquetry.

According to an important preferred form of embodiment, the height differences in the upper surface, which determine the individualized global surface levels, are formed as impressions in the top layer of the floor panel.

This important preferred form of embodiment and the invention in general according to this first aspect and/or the following aspects are preferably applied with laminate floor panels of the "DPL" (Direct Pressure Laminate) type. Such laminate floor panels comprise a substrate with a top layer provided on the substrate by means of press treatment. Herein, the top layer comprises one or more carrier sheets soaked in resin, more particularly layers of paper. Herein, the decor preferably is printed onto one of the aforementioned carrier sheets, although it is not excluded that the decor has been obtained in another manner, too. At the bottom side of the substrate, a backing layer is provided, preferably during said press treatment, which layer also consists of a carrier sheet soaked in resin. The substrate of such type of laminate floor panel may consist, for example, of finely ground wood held together by a binding agent, such as chipboard or fiberboard. Preferably, the substrate consists of MDF or HDF (Medium or High Density Fiberboard).

The aforementioned height differences, which are created because the upper surface of the floor panel, at the location of one or more wood parts, shows an individualized global surface level, are preferably situated between 0.1 and 0.3 millimeters.

According to the aforementioned important preferred form of embodiment, said impressions, with laminate floor panels, either may or may not extend up into the substrate, depending on the desired depth of the impressions. Amongst others in the case that the impressions extend up into the substrate, it is not excluded that the height differences are larger than 0.3 millimeters.

Independently of the fact whether the floor panel shows the characteristics of the aforementioned important preferred form of embodiment, however, preferably in combination with these characteristics, moreover local impressions may be realized in the upper surface of the floor panel. These impressions will preferably be performed according to one or more of the following possibilities:

- impressions representing wood pores, wherein these impressions preferably correspond to the wood structure of the aforementioned wood parts;
- impressions representing grooves and/or gaps between the wood parts;
- impressions representing grooves and/or gaps between the wood parts, wherein these impressions vary in width;
- impressions representing cracks or ruptures;
- impressions representing worn-off portions;
- impressions representing wood pores or other local unevennesses, however, wherein these impressions as such are locally omitted and thus are interrupted in order to imitate scratches and the like.

According to still another possibility of performing local impressions, the wood pattern may represent one or more wood silver grains, and the floor panel may show at its upper surface, at the location of at least one of the aforementioned wood silver grains, an impression, wherein the surface of this impression or at least one wall of this impression is composed of several facet-shaped smaller surfaces. By "composed of facet-shaped smaller surfaces" is meant that the respective surface of the impression is composed of clearly delineated smaller surfaces, which preferably as such are flat or concave, however, globally form the curved surface of the respective impression. It is not excluded that the aforementioned facet-shaped smaller surfaces show an individualized gloss degree.

It is evident that the application of facet-shaped smaller surfaces in order to compose a surface of an impression represents an inventive idea as such, independently of the fact whether it is applied in combination with the characteristics of the first aspect. Such impressions, more particularly for imitating wood silver grains, can also be applied in other floor panels that comprise a top layer of synthetic material, as, for example, floor panels of the "DPL" type in general. By applying this facet-shaped smaller surfaces is obtained that a refraction and/or reflection of the light takes place that gives optical effects which are comparable to the light effects with, for example, real wood silver grains. It is evident that, according to this idea, it is not excluded that facet-shaped smaller surfaces are also applied for other impressions than with those intended for imitating wood silver grains. So, for example, may such impressions also be applied when imitating stone species, such as marble.

As mentioned above, a floor panel can be provided with impressions at its surface, said impressions representing grooves and/or gaps between the wood parts represented in the pattern, said impressions varying in width. It is noted that the application of grooves varying in width as such relates to an independent aspect of the invention. According to its second independent aspect, the invention thus relates to a floor panel, wherein this floor panel comprises a decor, as well as a top layer or laminate layer based on synthetic material, wherein the decorative side of the floor panel shows a pattern representing several wood parts, and wherein the floor panel, at its upper surface, also shows at least one groove corresponding to the transition between two of the aforementioned represented wood parts, with as a characteristic that, seen in cross-section, the location where said groove intersects the actual upper surface, varies laterally along said transition. Herein, this preferably concerns a groove, which, at the actual upper side of the floor panel, varies in width according to the longitudinal direction of the groove. According to a variant, the groove may also be made undulating in respect to the theoretical transition between the wood parts, wherein the width as such then either varies or not.

Floor panels showing the characteristics of this second aspect, when composed to form a floor covering, render a less artificial impression. Moreover, such grooves allow to give the impression of antique parquetry. Said groove thus preferably will imitate a gap between two wood parts.

Preferably, said transition is delineated in the pattern with a globally darker color. Hereby, it is obtained that even relatively shallow grooves, for example, grooves that do not extend up into the substrate of a laminate floor panel, or, in other words, are situated exclusively in the top layer, still are experienced as deep gaps.

It is noted that the aforementioned grooves can be provided with a separately provided decorative covering, which preferably comprises a hardened substance, which has been provided in the groove in non-hardened condition and subsequently has been hardened. To this aim, techniques can be used which are known as such, for example, from WO 2004/108436. It is evident that also other local impressions provided in the upper surface of the floor panel can be provided with a separate decorative covering, such as a hardened substance. By providing a separate decorative covering can be achieved that the respective grooves or other local impressions, such as impressions representing cracks and/or ruptures, contrast more with the pattern represented by the decor and/or will be present in the upper surface of the floor panel in a more expressed manner.

The aforementioned groove may be realized according to a plurality of possibilities. A first possibility consists in that the groove is formed by an impression, whereby the decor and the top layer then preferably extend continuously through this impression. A second possibility consists in that the aforementioned groove is formed by the removal of a material portion from the upper surface of the floor panel. In the case this relates to a laminate floor panel, according to the second possibility, for example, the top layer and possibly a portion of the substrate directly under the top layer are removed.

It is noted that the present invention also relates to a method for manufacturing a floor panel with the characteristics of the first and/or the second aspect, wherein the height differences mentioned in the first aspect and/or the groove mentioned in the second aspect, respectively, are formed by an impression, with as a characteristic that the floor panel, either as such, or while still being part of a larger board of which it is formed, is manufactured by means of a press process, wherein in this press process, the respective impressions in the upper surface of the floor panel, the larger board, respectively, are provided, wherein use is made of a press plate, which, in order to perform the respective impressions, is provided with a relief at its pressing side, wherein the relief for forming said impressions is realized at least partially by means of a machining treatment by means of a mechanical tool, for example, by means of a milling process.

The application of this method allows to manufacture floor panels with the characteristics of the first and/or second aspect of the invention in an efficient and/or inexpensive and/or environmentally friendly manner. By using a machining treatment with a mechanical tool, material can be removed from the press plate more efficiently than by means of, for example, an etching process. With the floor panels with the characteristics of the first and/or second aspect of the invention, major quantities of material must be removed from the press plate in order to form lower-situated relief portions. During the pressing process, these lower-situated relief portions determine, for example, the global surface levels of the separate wood parts, whereas the higher-situated relief portions determine, for example, the grooves mentioned in the second aspect. By realizing the aforementioned relief, more particularly the aforementioned lower-situated relief portions, at least partially by means of a machining treatment with a mechanical tool, it is avoided that these portions have to be etched away, and is obtained that, as a result, time is saved. At the same time, the environment is damaged less, as the consumption of an environmentally-unfriendly etching agent is kept low.

By realizing the press plate at least partially by means of a machining treatment, also the advantage is obtained that inclined and/or curved portions can be made without steps, contrary to solely etched press plates. This is in particular important when very small slopes must be realized over a major distance. With an etched press plate, this would in fact require a large number of etching cycles with very small etching depths, whereas with a machining treatment any slope can be realized without steps or almost without steps, even when it extends over major distances. In order to work very accurately, the machining treatment moreover preferably is performed by means of a milling tool, more particularly a spherical cutter.

Preferably, however, in combination with the machining treatment by means of a mechanical tool, also an etching process will be used when preparing the press plate. Namely, by means of an etching process additional projections can be provided at the press side, said projections being intended for providing, during the pressing process, said local impressions at the upper surface of the floor panel, which impressions are intended, for example, for imitating wood pores or other wood structures.

According to its first and second aspect, separately or in combination, the invention in particular shows its advantages in two important preferred forms of embodiment.

In a first important preferred form of embodiment of the first and/or second aspect of the invention, the aforementioned pattern represents a so-called multiplank. In that case, the aforementioned represented wood parts extend over the upper surface of the floor panel with their longitudinal directions substantially parallel to each other.

In a second important preferred form of embodiment of the first and/or second aspect of the invention, the aforementioned pattern represents a so-called parquet tile, wherein said represented wood parts extend with their longitudinal directions over the upper surface of the floor panel in at least two different directions. Preferably, this relates to parquet tiles known by the denominations of Versailles tile or small Versailles tile. However, it is not excluded that the pattern represents other parquet tiles, such as parquet tiles known by the denominations of Bastide tile, Chantilly tile, Chaumont tile, Montalembert tile, Nantais tile or Soubise tile; other fantasy patterns comprising images of wood parts are not excluded, either.

When the pattern relates to a parquet tile, the invention preferably will relate to floor panels with dimensions that are larger than 35 by 35 centimeters, and still better with dimensions of approximately 60 by 60 centimeters. The thickness of floor panels with the characteristics of the first or of the second aspect of the invention preferably is between 5 and 20 millimeters and still better between 7 and 15 millimeters. Of course, it is not excluded that the floor panels have other dimensions.

It is clear that the invention also relates to a floor covering that is composed of floor panels showing the characteristics of the first and/or the second aspect.

According to a deviating variant of the invention, the characteristics of the first and/or second aspect can also be applied in an analogous manner to floor panels with a decor representing several stone tiles instead of wood parts.

According to a third aspect of the invention, it relates to a floor covering, of the type that is composed of floor panels comprising a decor, as well as a top layer based on synthetic material, wherein these floor panels, at least at two opposite edges, are provided with mechanical coupling parts allowing to couple two of such floor panels to each other at the aforementioned edges, such that in coupled condition a locking in horizontal direction as well as in vertical direction is obtained, with as a characteristic that in the upper surface of the floor covering one or more height differences are present because the upper surface, at the location of one or more of the floor panels, shows an individualized global surface level. This third aspect has the same underlying inventive idea as the first aspect, however, different from the first aspect, the third aspect does not require that different individualized global surface levels are showing in the surface of one and the same panel, however, among different floor panels in mutual respect.

The third aspect is useful, amongst others, with floor panels of which the decor represents precisely one wood part or plank, such that such individualized global surface level extends substantially over the surface of one floor panel.

The third aspect may also be applied with a floor covering consisting of floor panels, the decor of which panels represents precisely one stone tile, such that such individualized global surface level extends substantially over the surface of one floor panel.

In this manner is obtained that there are wood parts, more particularly planks, or imitated tiles in the floor covering, the global surface level of which is individualized and thus deviates from the theoretical general plane that is determined by the upper side of the floor covering, for example, in that the imitated wood part or the imitated tile shows a global surface that is situated higher or lower, and/or that is globally inclined and/or globally curved in respect to the aforementioned theoretical general plane.

According to the third aspect, the individualized global surface level preferably thus is realized according to at least one of the following possibilities:

- in that, at the location of a respective floor panel, the surface as a whole is situated substantially higher or lower than the surface of one or more adjacent floor panels and/or is situated higher or lower than the average height of the surface of the floor covering;
- in that, at the height of a respective floor panel, the global surface is at least partially inclined in respect to the general plane according to which the floor covering extends;
- in that, at the height of a respective floor panel, the global surface is made curved, more particularly is concave or convex;
- in that, at the location of a respective floor panel, the surface is made deeper in a sloping manner in the direction of an edge or corner.

Also according to the third aspect, it is preferred that the different individualized global surface levels are formed in that the floor panels are differently impressed in function of the desired surface level.

All subordinate characteristics of the first aspect may also be applied as subordinate characteristics of the third aspect, inasmuch as this does not imply a contradiction.

It is evident that the invention also relates to a set of floor panels, with as a characteristic that this set comprises floor panels forming, in coupled condition, a floor covering according to the aforementioned third aspect.

According to a fourth aspect, the invention relates to a floor covering of the type that is composed of several floor panels comprising a printed decor, as well as a top layer based on synthetic material, wherein these floor panels, at least at two opposite edges, are provided with mechanical coupling parts allowing to couple two of such floor panels to each other at the aforementioned edges, wherein in coupled condition a vertical as well as horizontal locking is obtained, with as a characteristic that the floor covering is at least composed of main floor panels with a pattern in the form of parquet tiles and edge finishing panels with an edge finishing pattern. As use is made of mechanically interlockable floor panels, for the main floor panels as well as for the edge finishing panels, an edge finishing around the main floor panels can be performed in a simple manner, without any particular measures. It is noted that the aforementioned coupling means allow at least for a mutual coupling of the main floor panels, as well as for a mutual coupling of the edge finishing panels, however, still better also for a mutual coupling of the main floor panels and the edge finishing panels. Further characteristics of this fourth aspect will become clear from the detailed description.

DESCRIPTION OF THE DRAWINGS

With the intention of better showing the characteristics of the invention, hereafter, as an example without any limitative character, several preferred forms of embodiment are described, with reference to the accompanying drawings, wherein:

FIGS. 11 and 12 represent another floor panel according to the present invention, wherein FIG. 12 represents a cross-section according to line XII-XII in FIG. 11;

DETAILED DESCRIPTION OF PREFERRED EMBODIMENTS OF THE INVENTION

Figure 1:
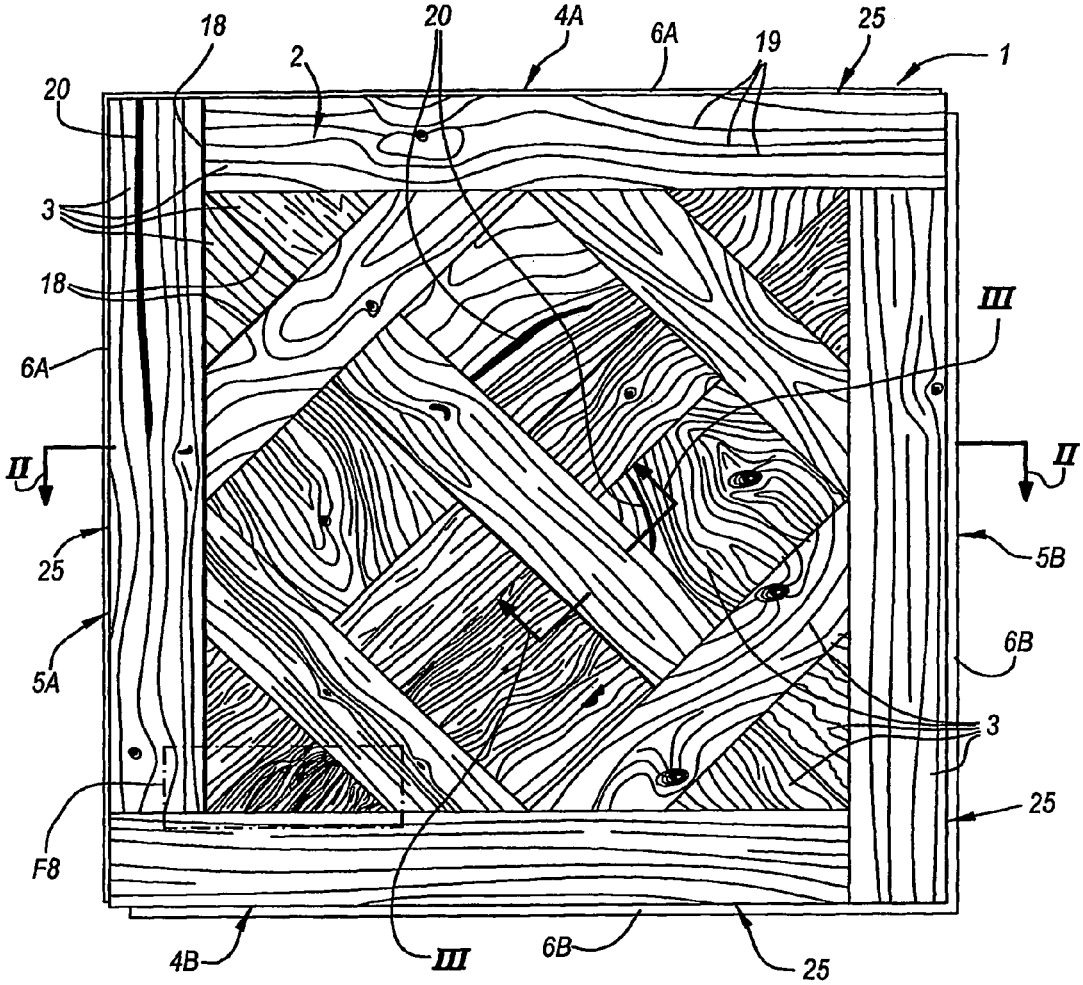
FIG. 1 represents a floor panel according to the present invention.
Figure 2:
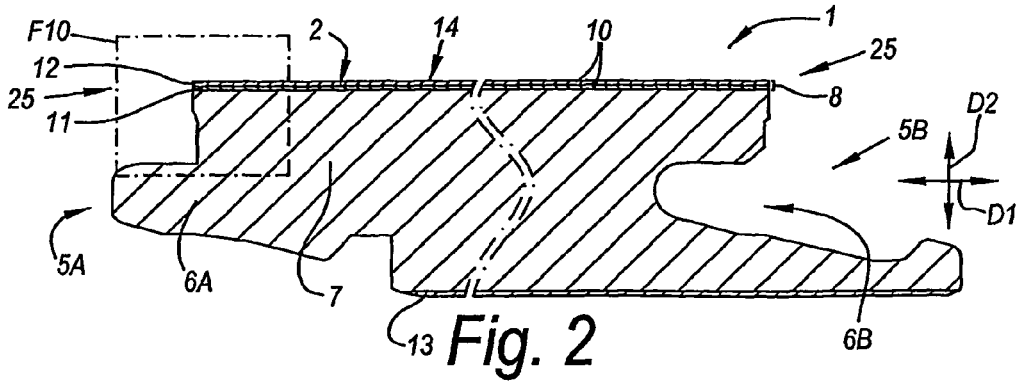
FIG. 2 represents a cross-section according to the line II-II in FIG. 1.

FIGS. 1 and 2 represent a floor panel 1 with, amongst others, the characteristics of the first aspect of the invention. The floor panel 1 comprises a decor 2 representing a pattern with several wood parts 3. In the example of FIG. 1, the pattern represents a so-called parquet tile. Herein, the wood parts 3 extend with their longitudinal directions in several directions. More particularly, the represented pattern relates to a so-called "small Versailles" tile. Herein, the term "small Versailles" relates to the arrangement of the represented wood parts 3, said arrangement being known as such.

FIG. 2 shows that the floor panel 1, at its edges 4A-4B and 5A-5B, is provided with coupling means 6A-6B known as such, which make it possible to couple several of such floor panels 1 at their edges 4A-4B and 5A-5B in order to form, for example, a so-called floating floor covering. The represented coupling means 6A-6B allow to realize a connection in horizontal direction D1, this is perpendicular to the respective edge 4A-4B or 5A-5B and in the plane of the floor panel 1, as well as in vertical direction D2, this is perpendicular to the plane of the floor panel 1, among two of such floor panels 1. Similar coupling means are known, for example, from the international patent applications WO 97/47834 or WO 01/98603. It is noted that the invention relates to floor panels 1 that can be composed to a floor covering in any manner; however, preferably coupling means 6A-6B are applied that enable a glueless connection, such as, for example, the represented coupling means 6A-6B or the coupling means of the aforementioned international patent applications.

Figure 3:
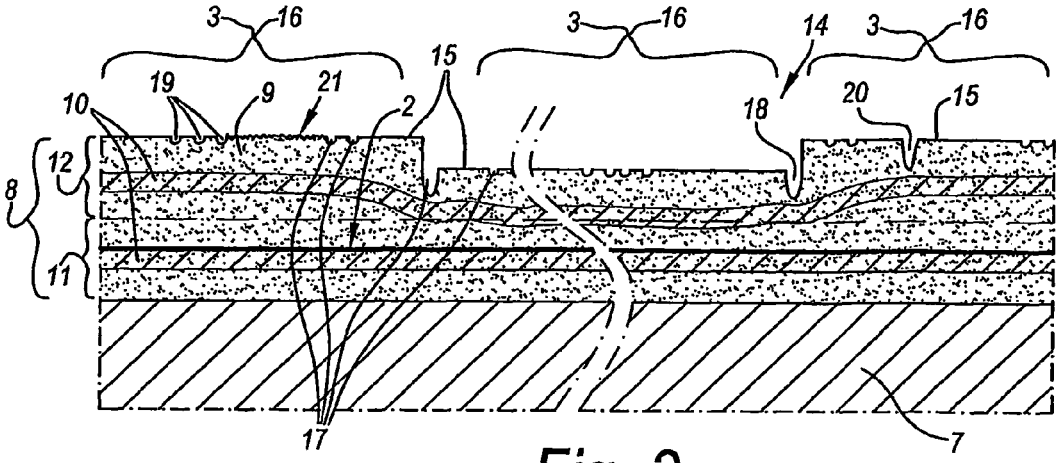
FIG. 3, at a larger scale, represents a cross-section according to line III-III in FIG. 1.

FIG. 3 represents a cross-section according to the line III-III represented in FIG. 1. This cross-section clearly shows that the floor panel 1 relates to a laminate floor panel with a top layer 8 provided on a substrate 7 by means of a press treatment. In the represented example, the top layer 8 comprises two carrier sheets 10 soaked in synthetic material or in resin 9. One the one hand, this relates to a so-called decor layer 11 or, in other words, a paper layer 10 soaked in resin 9, upon which the decor 2 is printed, and, on the other hand, a so-called overlay 12 or, in other words, a transparent paper layer 10 soaked in resin 9, with which layer the decor 2 is covered. The aforementioned transparent paper layer 10 and/or the resin 9, in which this layer 10 is soaked, herein preferably also comprises substances with a high wear resistance, such as corundum particles. As FIG. 2 represents, preferably a backing layer 13 is provided at the bottom side of the substrate 7. This backing layer mostly also consists of a carrier sheet 10 soaked in resin 9.

FIG. 3 clearly shows that a plurality of levels 15 is present in the upper surface 14 of the floor panel 1, in that the upper surface 14, at the location of the wood parts 3, shows individualized global surface levels 16.

By "global surface level" 16, according to the present invention the level 15 of the upper surface 14 of the floor panel 1 or of a portion of the floor panel 1 is meant, without considering the local impressions 17, such as the represented gaps 18 and impressions 19 that imitate wood structure.

The individualized global surface levels 16 are realized in FIG. 3 in that the upper surface 14 of the floor panel 1, at the location of a wood part 3, is made deviating or different in respect to the upper surface 14 at the location of an adjacent wood part 3. The deviation consists in that at the location of the respective wood part 3, the upper surface 14, or, in other words, the global surface level 16 of the wood part 3 shown centrally in FIG. 3, as a whole is situated lower than the global surface levels at the location of the adjacent wood parts 3, or, in other words, is situated lower than the surface levels 16 of the wood parts 3 shown in FIG. 3 at the left and right hand sides, respectively.

Figure 4:
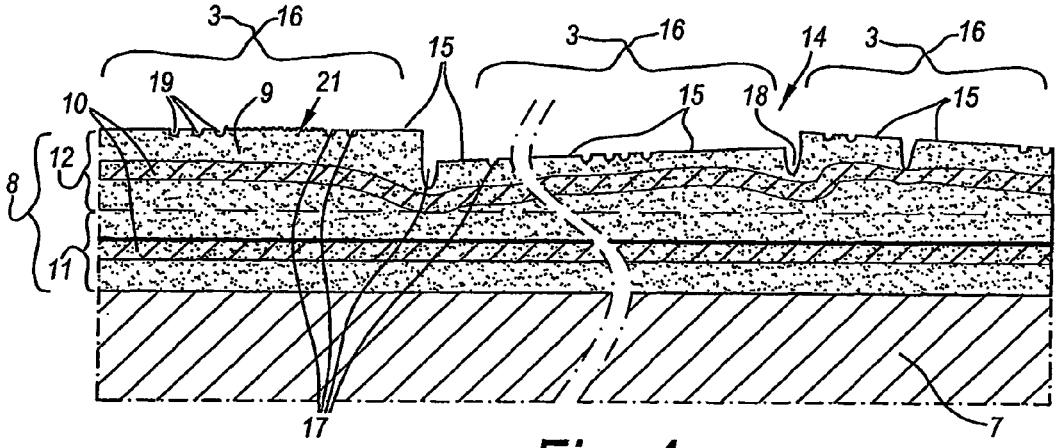
FIGS. 4 to 7 represent variants of the portion depicted in FIG. 3.

In the variant of FIG. 4, the individualized global surface levels 16 are realized, amongst others, in that the upper surface 14, at the location of several wood parts 3, is partially inclined in respect to the general upper surface 14 of the floor panel 1. This relates more particularly to the global surface levels 16 of the central wood part 3 and the one represented at the right hand side in the figure.

Figure 5:
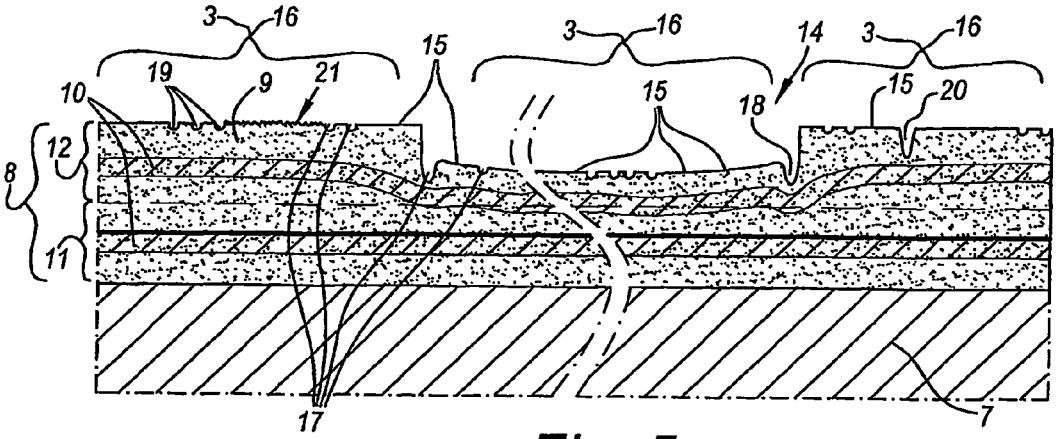
Figure 6:
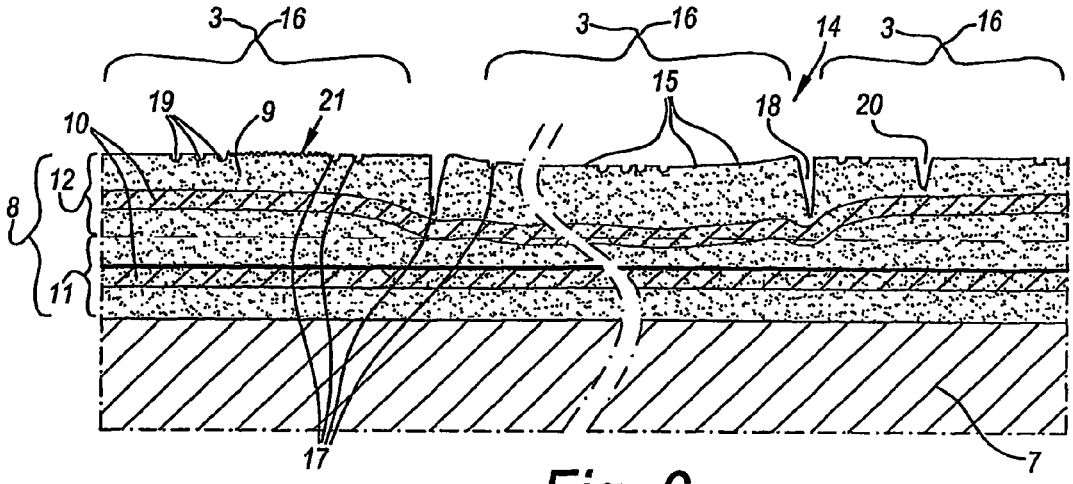

In the examples of FIG. 5 and FIG. 6, the individualized global surface levels 16 are realized, amongst others, in that the upper surface 14 is made concave at the location of a wood part 3. In this case, this relates to the global surface level 16 of the centrally represented wood part 3. Moreover, the surface level 16 of the centrally represented wood part 3 in the example of FIG. 5 is also situated lower than the surface levels 16 of the adjacent wood parts 3.

Figure 7:
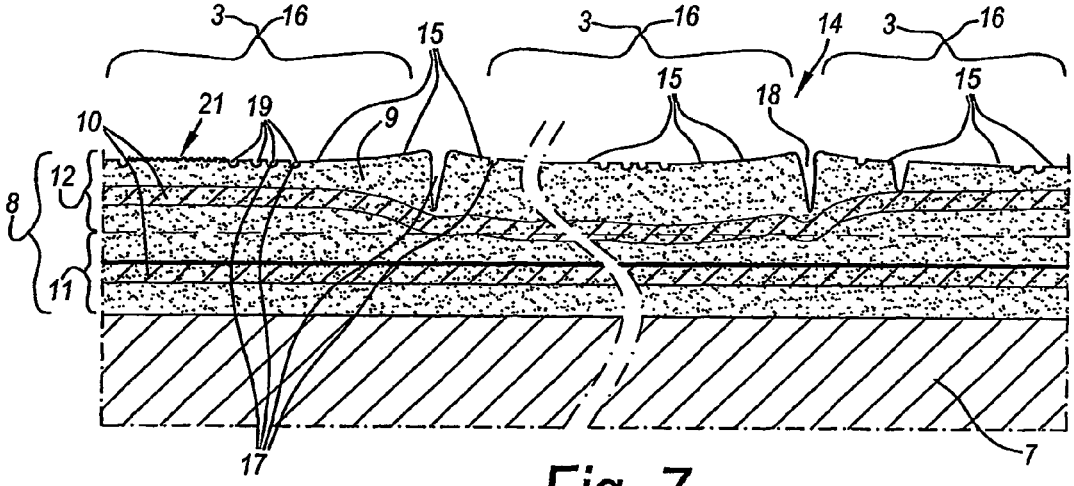

In FIG. 7, still another possibility is represented for realizing a floor panel 1 according to the first aspect of the invention. Herein, the global surface level 16 of each of the wood parts 3 is individualized in the same manner, in this case, by making it concave. The height differences that according to the invention are present in the upper surface 14 of the floor panel 1, herein manifest themselves in particular in the global surface level 16 of each wood part 3 separately.

As represented in FIG. 1 and FIGS. 3 to 7, also local impressions 17 are realized in the upper surface 14 of the floor panel 1. The represented floor panels 1 comprise, amongst others, impressions 19 representing wood pores or wood structure, impressions 18 representing grooves and/or gaps between the wood parts 3, and impressions 20 representing cracks and/or ruptures. Also, as represented in FIG. 3 to 7, zones 21 with a deviating gloss degree can be provided.

It is evident that all possibilities described above by means of FIGS. 3 to 7 can be combined at random in one and the same floor panel. of course, also other forms of embodiment are possible in order to realize the first aspect of the invention. It is also noted that the FIGS. 3 to 7 are solely schematic representations. In reality, the applied height differences and widths of local impressions, in respect to dimensions, preferably will be in the order of magnitude as this is the case with real parquet tiles or the like.

Figure 8:
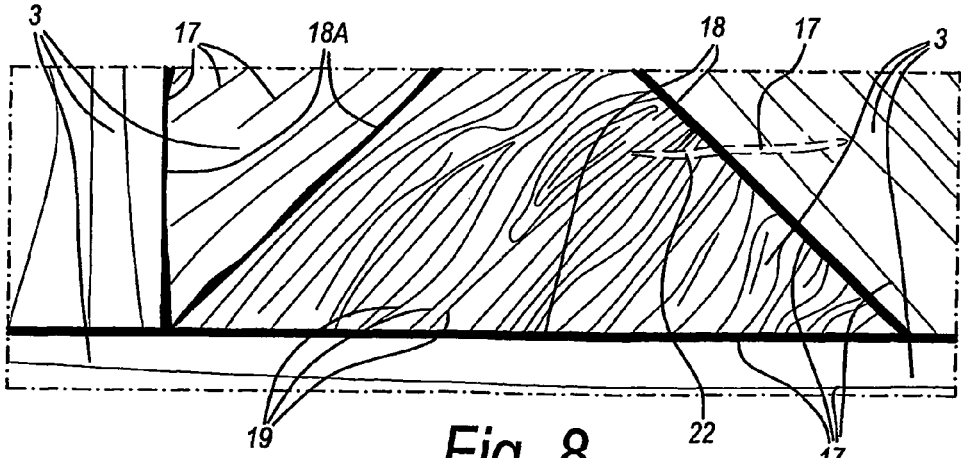
FIG. 8, at a larger scale, represents a possible form of embodiment of the portion indicated by F8 in FIG. 1.

FIG. 8 represents still further examples of local impressions 17. So, for example, does the floor panel 1 represented in FIG. 8 comprise impressions 18-18A, which represent grooves and/or gaps between the wood parts 3, wherein the impressions 18A vary in width. Also, the local impressions 19 imitating wood pores are locally omitted or interrupted at the location of the area 22 represented in dashed line, in order to imitate scratches or the like. It is not excluded that this area 22 as such also shows a local impression 17 with the intention of imitating a material portion that has been removed by wear.

It is evident that the floor panel 1 represented in FIG. 8 also shows the characteristics of the second aspect of the invention. To this aim, the floor panel 1 also has at least one groove 18A at its upper surface, said groove corresponding to a transition between two of the represented wood parts 3. Seen in cross-section, the location where said groove 18A intersects the actual upper surface 14 varies laterally along the theoretical transition between the respective two adjacent wood parts 3. Herein, the represented groove 18A varies in width at the actual upper side of the floor panel 1 according to its longitudinal direction and imitates an irregular gap between two wood parts 3.

It is noted that the example of FIG. 8 comprises grooves 18 of constant width, as well as grooves 18A of varying width. Further, it is noted that apart from real grooves 18 or 18A in the upper surface 14 of the floor panel 1 also possibly grooves can be observed that are solely represented in the pattern. Combining real grooves 18-18A with optical grooves solely represented in the pattern can reduce the complexity of manufacturing a floor panel according to the invention considerably, while still obtaining a realistic result.

It is noted that the grooves 18-18A preferably are represented in a dark color. Instead of depicting the representation exclusively in the pattern, such dark-colored groove 18-18A may also be realized by providing a separate decorative covering in the grooves 18-18A, for example, by spreading a dark paint, ink or the like in these grooves and letting it harden therein.

Figure 9:
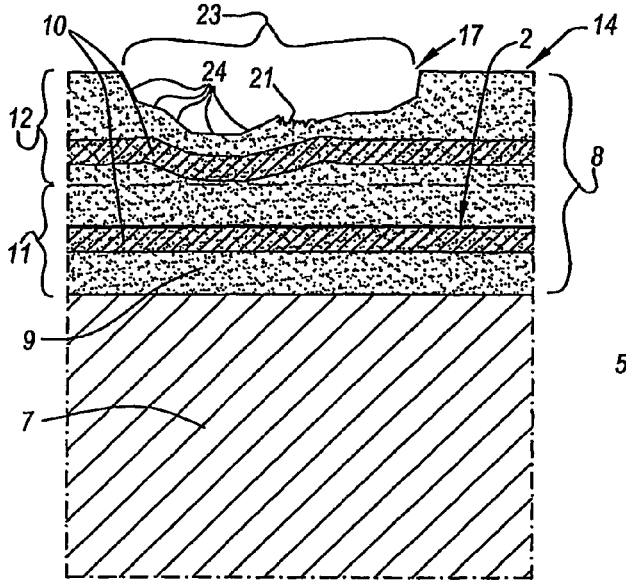
FIG. 9, in cross-section, represents another detail of a possible form of embodiment of the invention.

FIG. 9 represents in cross-section a local impression 17 with a surface 23 that is composed of several facet-shaped smaller surfaces 24. Such impression 17 is preferably applied when the pattern of the floor panel 1 represents one or more wood silver grains. The local impression 17 represented in FIG. 9, which impression is composed of facet-shaped smaller surfaces 24, then preferably is situated at the location of one of the aforementioned represented wood silver grains.

Possibly, certain ones of these smaller surfaces 24, or certain areas thereof, can be made with different gloss degrees. In FIG. 9, such portion is indicated by reference 21, said portion in this case comprising a rougher surface structure and therefore is experienced as more matte.

Figure 10:
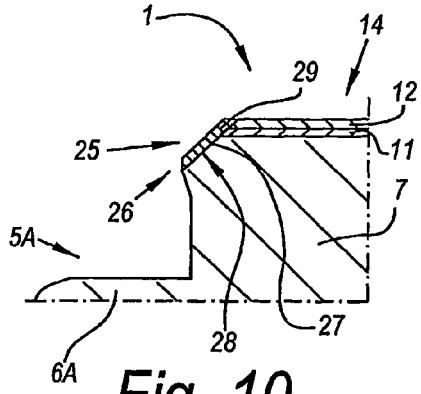
FIG. 10, at a larger scale, represents a variant of the portion indicated by F10 in FIG. 2.

According to a variant of the invention, as represented in FIG. 10, at the upper edge 25 of at least two and preferably of all opposite sides 4A-4B-5A-5B of the floor panel 1 according to the invention, a chamfer 26 can be provided, for example, in the form of a beveled edge 27, which, as in this case, may extend up into the substrate 7 of the respective laminate floor panel 1. The obtained surface 28 preferably is covered with a decorative layer 29, which can be obtained in any manner, for example, by applying paint, lacquer, transfer printing, printing by means of a digital printer, and the like. Cut-away material portions or chamfers 26 at the upper edge 25 of laminate floor panels 1 are known as such, for example, from WO 01/96688.

In the case that such chamfer 26 is applied with a laminate floor panel 1 with a pattern representing a parquet tile, the special effect is obtained that the floor panels 1, which represent a whole that as such is composed of several wood parts 3, however still are present in the floor covering clearly distinguishable as separate parquet tiles.

Figure 11:
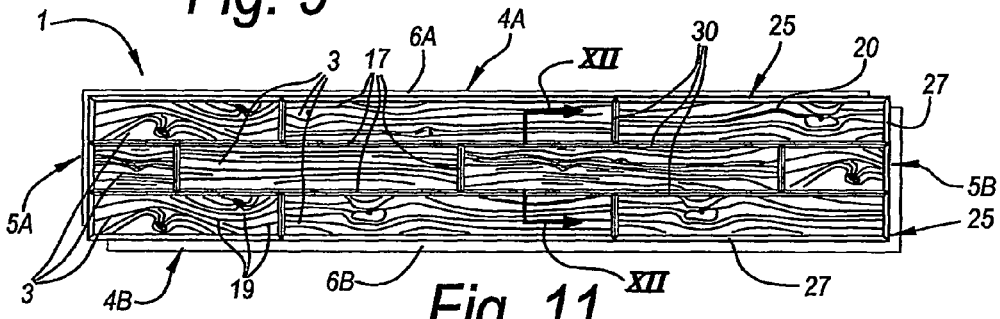
Figure 12:
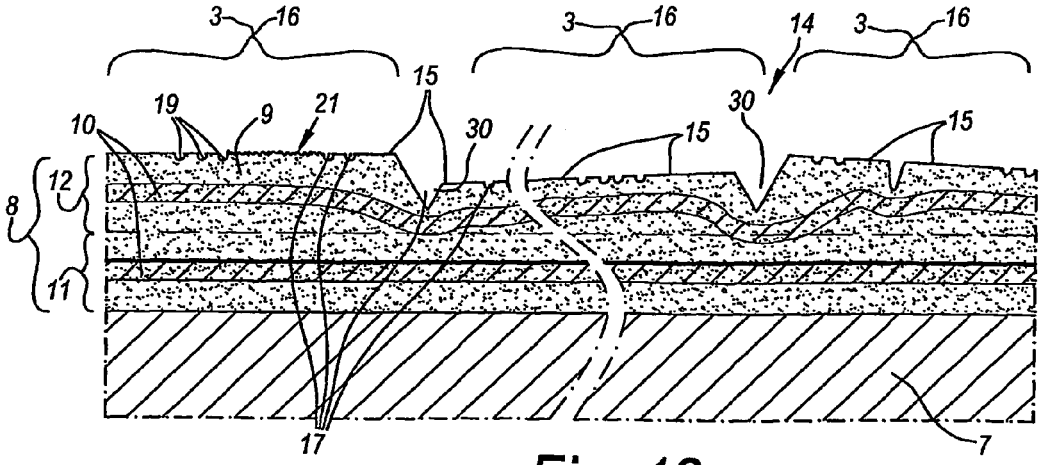

FIG. 11 shows a floor panel 1 with a pattern representing a so-called multiplank, in this case a three-strip plank. Herein, the represented wood parts 3 extend in three rows with their longitudinal directions substantially parallel to each other over the upper surface 14 of the floor panel 1. In FIG. 12, it can be seen very clearly that the floor panel 1 shows, amongst others, the characteristics of the first aspect of the invention. Moreover, the upper surface 14 comprises local impressions 17 in the form of V-shaped imitation chamfers or imitation beveled edges 30. It is clear that according to a variant, the invention can also be applied to so-called multiplanks, the decor of which represents two or more than three rows of planks.

As mentioned above, the floor panels 1 of the present invention, either as such, or while they still form a part of a larger board 31 of which then the final floor panel 1 is formed, may be manufactured with a press process. The different levels 15 in the upper surface 14, which, according to the first aspect of the invention, determine the individualized global surface levels 16, may then be formed during the aforementioned press process as impressions in the top layer 8. Also, the groove 18A mentioned in the second aspect of the invention may be formed by an impression 17, which has been provided in the top layer 8 during the aforementioned press process.

Figure 13:
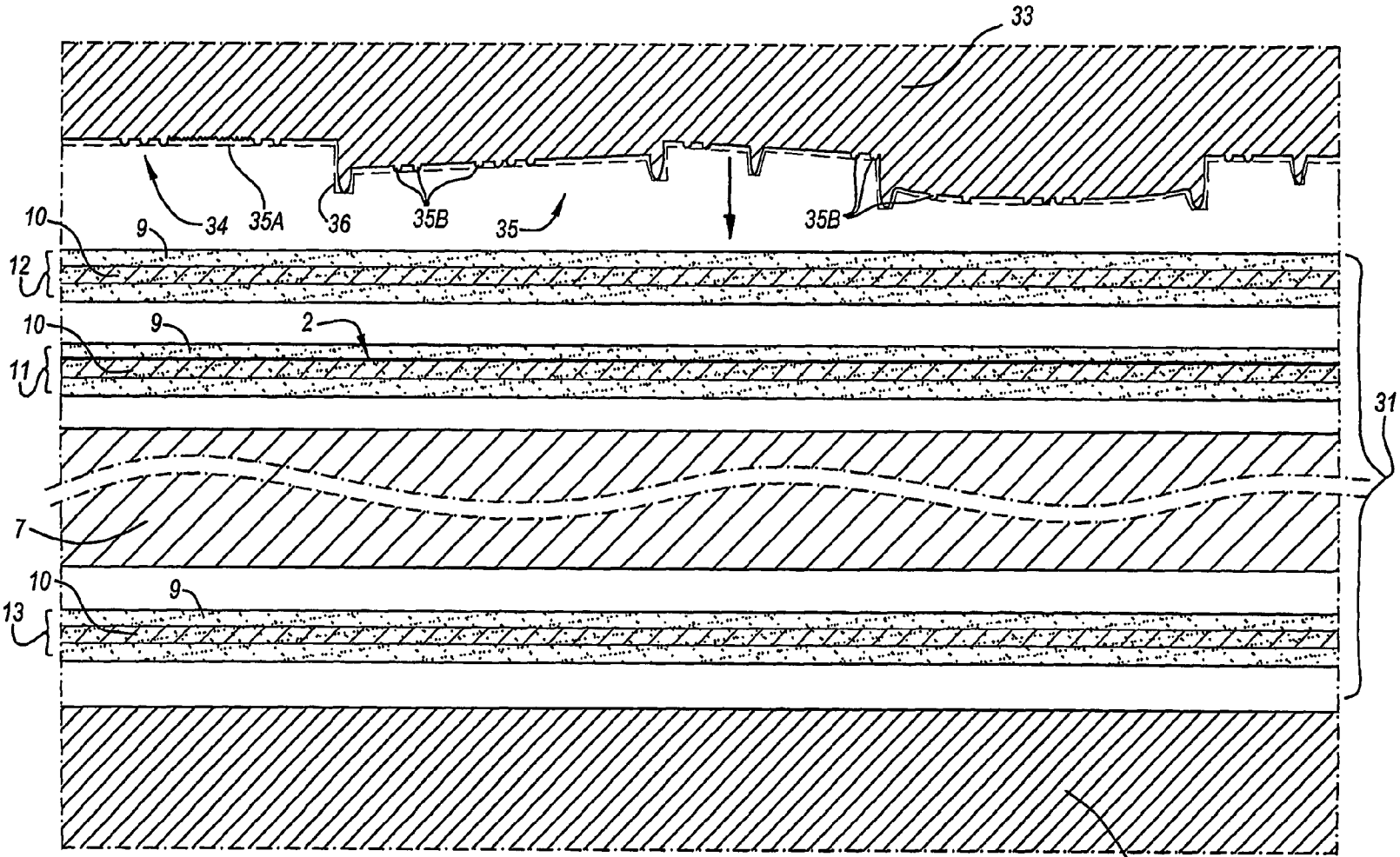
FIG. 13 illustrates a method for manufacturing a floor panel according to the invention.

FIG. 13 represents an example of a method, wherein a larger board 31 of laminate material, of which floor panels 1 can be formed, is prepared in a press process. Herein, the aforementioned backing layer 13, the substrate 7, the decor layer 11 and the possible overlay 12 are brought between a lower press plate 32 and an upper press plate 33, after which they are consolidated under increased pressure and temperature to the aforementioned larger board 31.

In the represented method, use is made of an upper press plate 33, which, at its pressing side 34, is provided with a relief 35 in order to realize the respective impressions, more particularly the impressions for forming the individualized surface levels 16 and/or the grooves 18A mentioned in the second aspect, in the upper surface 14 or the top layer 8 of the larger board 31. Such press plate 33 preferably is realized at least partially by means of a machining treatment by means of a mechanical tool, such as a milling process.

So, for example, in a first step, may the relief 35A, with which the aforementioned impressions are formed, be made by means of such machining treatment, whereby in this first step a relief 35A is obtained, as represented by the dashed line 36. Subsequently, in a second step, a second treatment, such as a chemical or electrochemical etching treatment, can be applied, by which then preferably at least the relief 35B for forming the local impressions 17 is formed and the final pressing side 34 is obtained.

Figure 14:
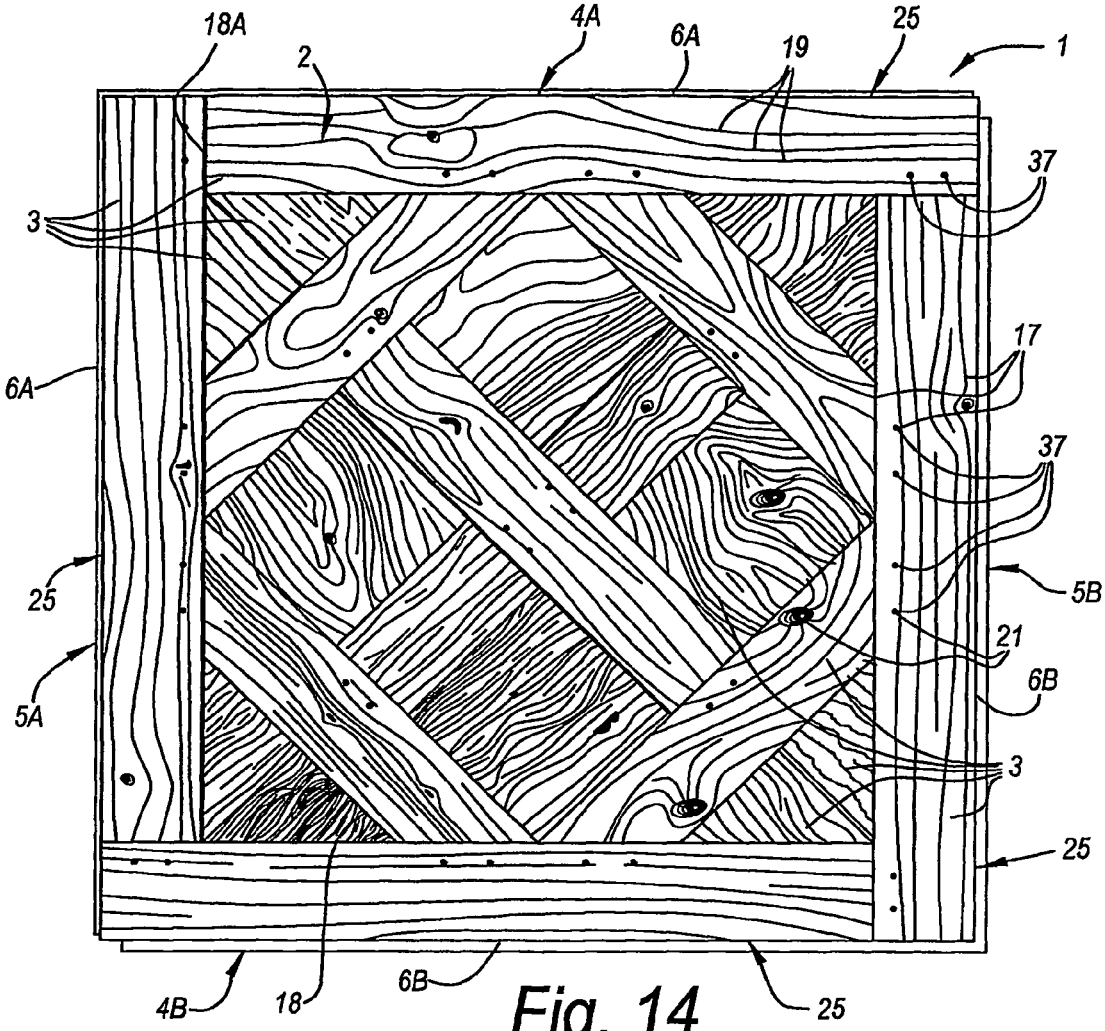
FIGS. 14 and 15 represent further variants of floor panels according to the invention.

FIG. 14 represents a small Versailles tile according to the invention, which also comprises imitations of nails 37 or pins. These are preferably at least depicted in the pattern. Possibly, the upper surface 34 of the floor panel 1 may additionally be provided, at the location of these imitations 37, with local impressions 17 or zones of deviating gloss degree 21.

Figure 15:
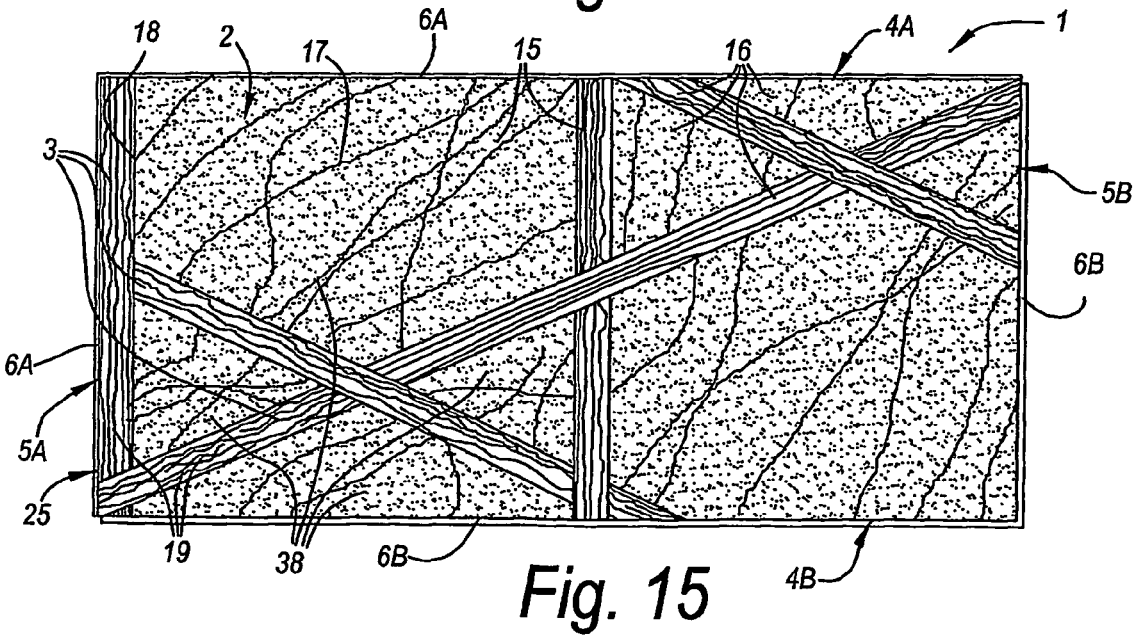

FIG. 15 represents another variant of the floor panel according to the present invention, wherein the aforementioned pattern, apart from wood parts 3, also represents other materials, such as marble or other stone species. It is clear that in that case, the aforementioned gaps or grooves 18-18A also may be situated between the aforementioned wood parts 3 and the represented stone surfaces 38 of the floor panel 1.

Figure 16:
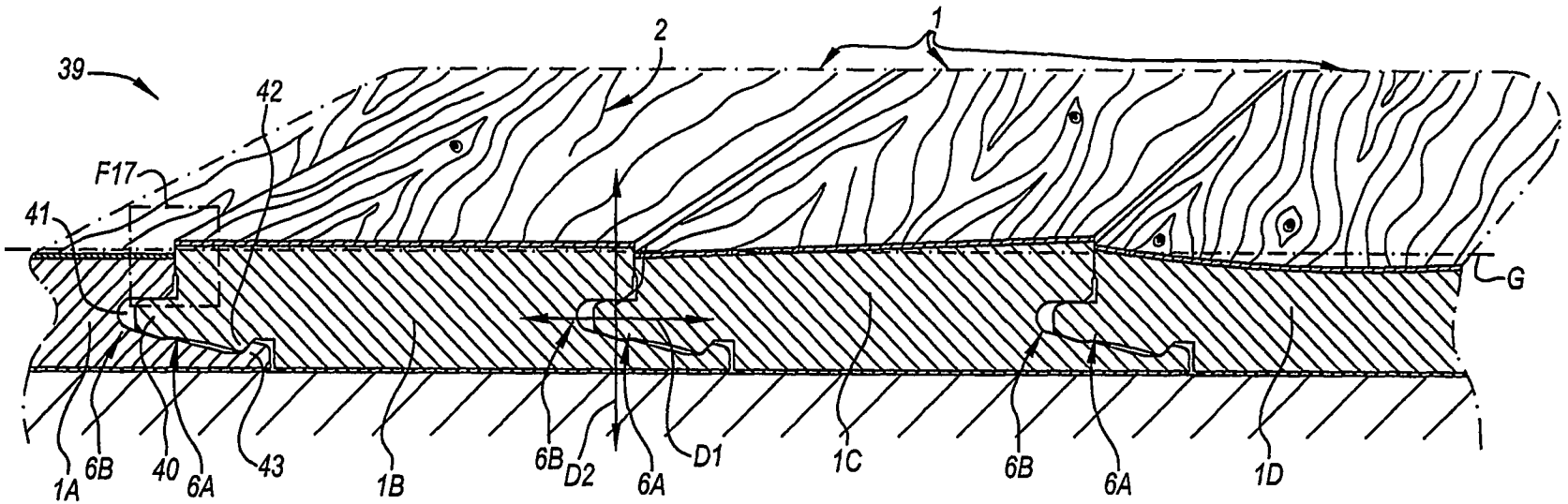
FIG. 16 schematically represents a form of embodiment of a floor covering that is made according to the aforementioned third aspect of the invention.

FIG. 16 schematically represents an example of a floor covering 39 meeting the aforementioned third aspect of the invention. The floor covering 39 is composed of floor panels 1 comprising a decor 2, as well as a top layer 8 based on synthetic material, wherein these floor panels, at least at two opposite edges, and in this case, at all four edges, are provided with coupling means 6A-6B, more particularly mechanical coupling parts, which allow to couple two of such floor panels 1 at said edges to each other, such that in coupled condition a locking in horizontal direction D1 as well as in vertical direction D2 is obtained. In the example of FIG. 16, these coupling parts, analogous to FIG. 2, consist of a tongue 40 and a groove 41, which are provided with locking parts 42 and 43 effecting the locking in horizontal direction. of course, other forms of mechanical coupling parts are possible. According to the third aspect, one or more height differences are present in the upper surface of the floor covering because the upper surface, at the location of one or more of the floor panels, shows an individualized global surface level. In other words, this means that there are floor panels present in the floor covering, the global surface level of which panels is individualized and thus deviates from the theoretical general plane of the floor covering.

In FIG. 16, different possibilities are represented, thus for the floor panels separately represented by 1A to 1D. Floor panels 1A and 1B show an individualized surface level in that their upper sides are situated on different heights and moreover are situated lower, higher, respectively, than the average height G of the surface of the floor covering. The surface of floor panel 1C is individualized in that, globally seen, it is inclined. The surface of floor panel 1D is individualized in that, globally seen, it is curved.

According to FIG. 16, the floor panels 1A to 1D solely have a decor 2 that represents precisely one wood part or plank per floor panel. It is clear that thereby, according to the third aspect of the invention, a very realistic imitation of a plank floor can be made.

It is also clear that the respective surface levels can be formed in a simple manner by realizing the respective floor panels 1A to 1D of boards that are impressed in a suitable manner, preferably at their upper surface. In the case that floor panels have to be realized of which the individualized surface must have a deviating height and/or must be inclined, it is not excluded to provide the boards, of which these floor panels are realized, at their bottom side with a suitable impression, such that the floor panels made thereof, after sawing them to size and after forming coupling means thereon, when laid onto a flat underlying surface, show different surface levels at their upper side. It is clear that with laminate floor panels, in particular of the DPL type, such impressions can be realized in the usual pressing procedure, such by making use of suitably profiled press plates.

Figure 19:
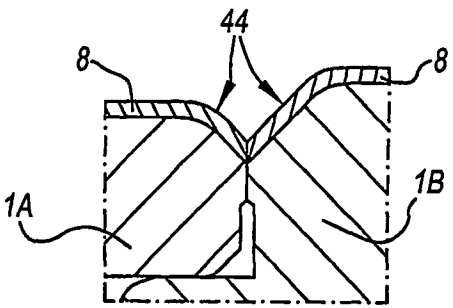
FIGS. 17 to 19, at a larger scale, represent the portion indicated by F17 in FIG. 16, however, for three variants.
Figure 18:
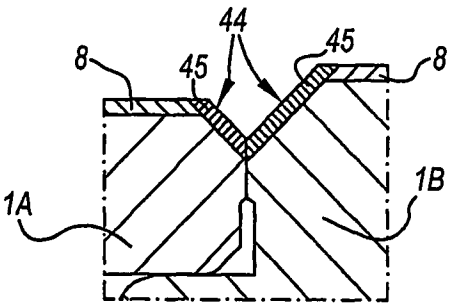
Figure 17:
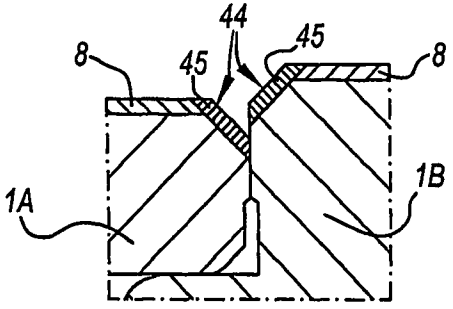

As represented in FIGS. 17 to 19, possible height differences at the edges may be masked or be leveled out by means of beveled edges 44 or the like. FIGS. 17 and 18 show two embodiments, wherein such beveled edges are provided with a separate covering 45, whereas FIG. 19 represents an embodiment, wherein the top layer 8 of the upper side each time continues over each respective beveled edge 44.

It is noted that, according to a particular form of embodiment of the first as well as of the third aspect, the floor panels 1 near their edges may also be made such that, without using a beveled edge, the surfaces each time adjoin each other at the same height, by providing for that each surface, next to the edge, rises or falls in height in order to end at the edge itself always at the same level. The individualized global surfaces then extend between edge zones, whereas the edge zones themselves are at equal height.

Figure 20:
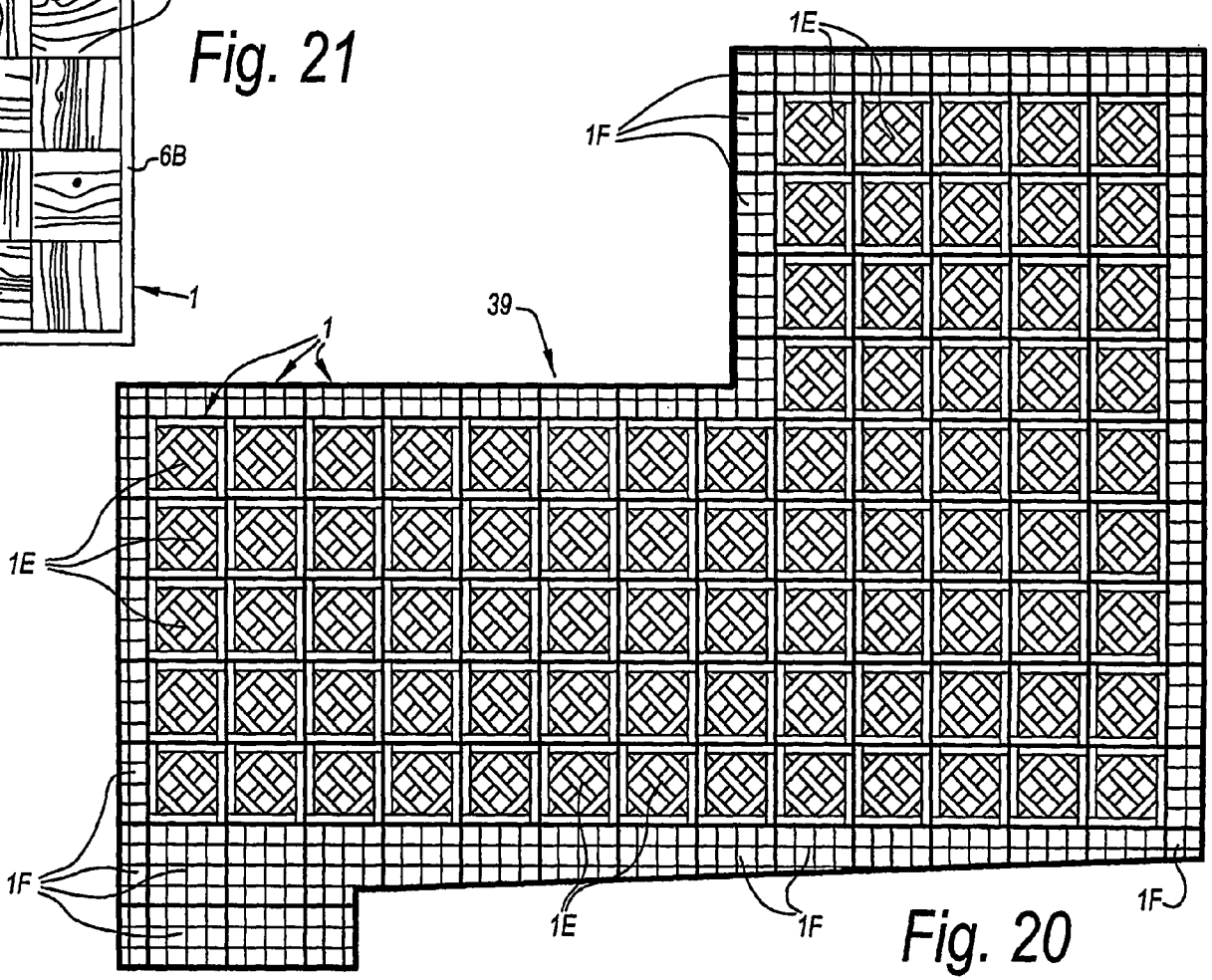
FIGS. 20 to 30 relate to a fourth aspect of the invention.

FIGS. 20 to 30 relate to floor coverings 39 that are realized according to the fourth aspect of the invention. Herein, FIGS. 20, 22, 24, 25 and 26 each represent in plan view a complete floor covering 39 for a not-rectangular room, in order to thereby illustrate the possibilities of a fourth aspect of the invention. As represented in the example of FIG. 20, this relates to a floor covering 39, of the type that is composed of several floor panels 1 comprising a printed decor 2, as well as a top layer based on synthetic material, wherein these floor panels, at least at two opposite edges, are provided with coupling means 6A-6B, more particularly mechanical coupling parts, which allow to couple two of such floor panels 1 to each other at said edges, wherein, in coupled condition, a vertical as well as horizontal locking is obtained, with as a characteristic that the floor covering is at least composed of main floor panels, specifically indicated by 1E, with a pattern in the form of parquet tiles, and edge finishing panels, specifically indicated by 1F, with an edge finishing pattern.

Figure 21:
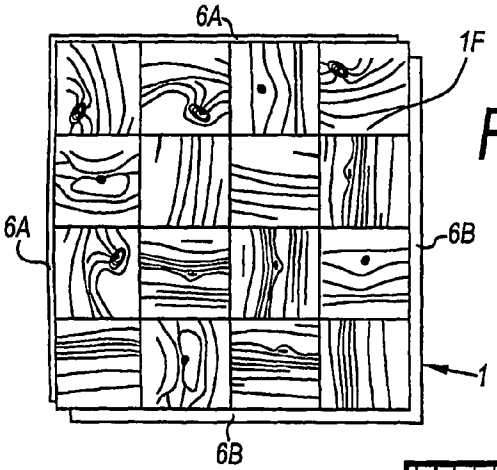

According to FIGS. 20 and 21, the edge finishing panels 1F consist of square floor panels with a checkered pattern, whereby the checks run parallel to the lateral edges of the floor panels.

As represented, it is preferred that the main floor panels 1E as well as the edge finishing panels 1F are square and have the same dimensions. Also, it is preferred that all floor panels, thus 1E as well as 1F, possess coupling means 6A-6B at all four edges, which for both kinds of floor panels are provided in a similar manner along the periphery. This allows that all floor panels can be interlocked row by row by means of known installation methods.

Figures 22, 23:
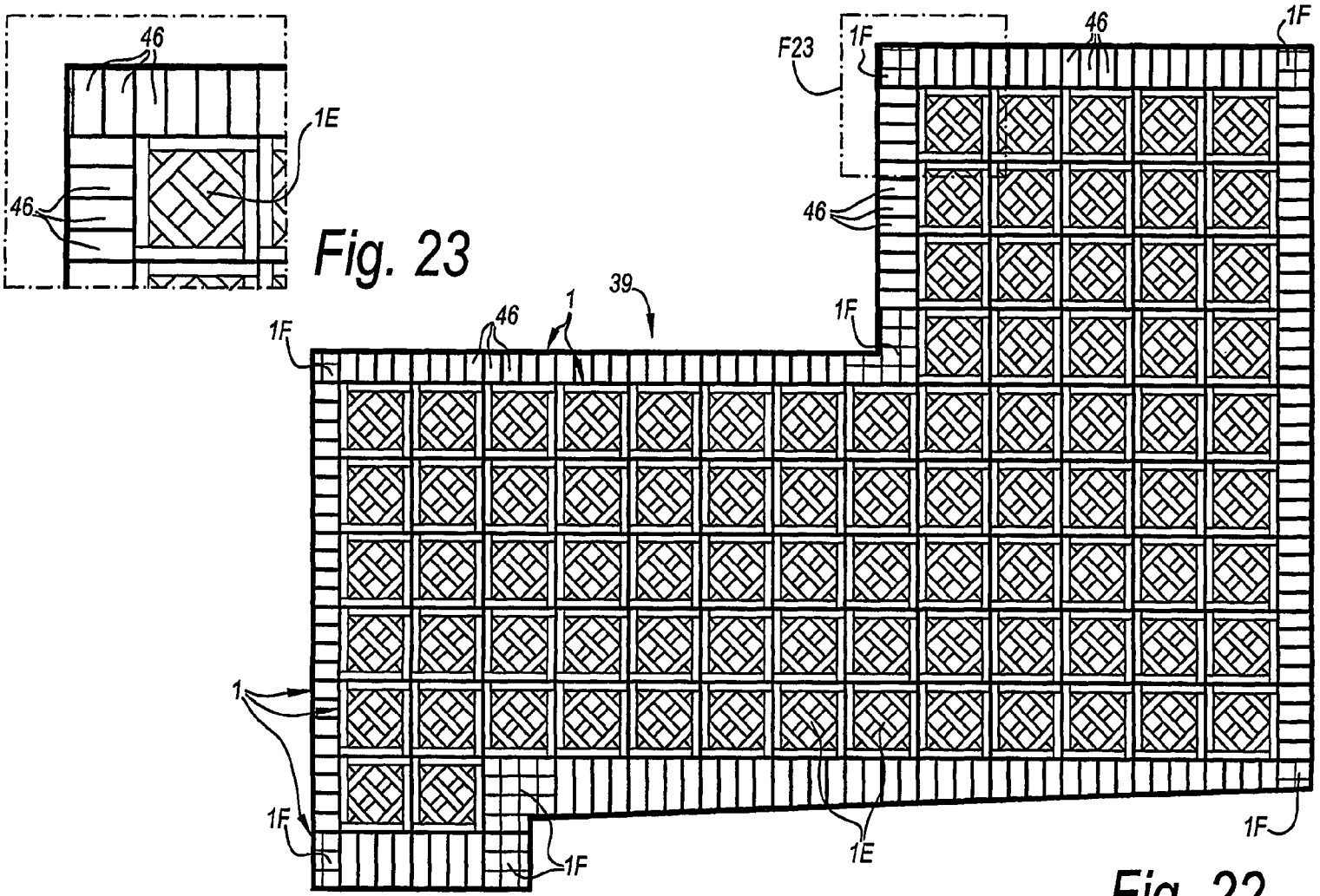
Figure 24:
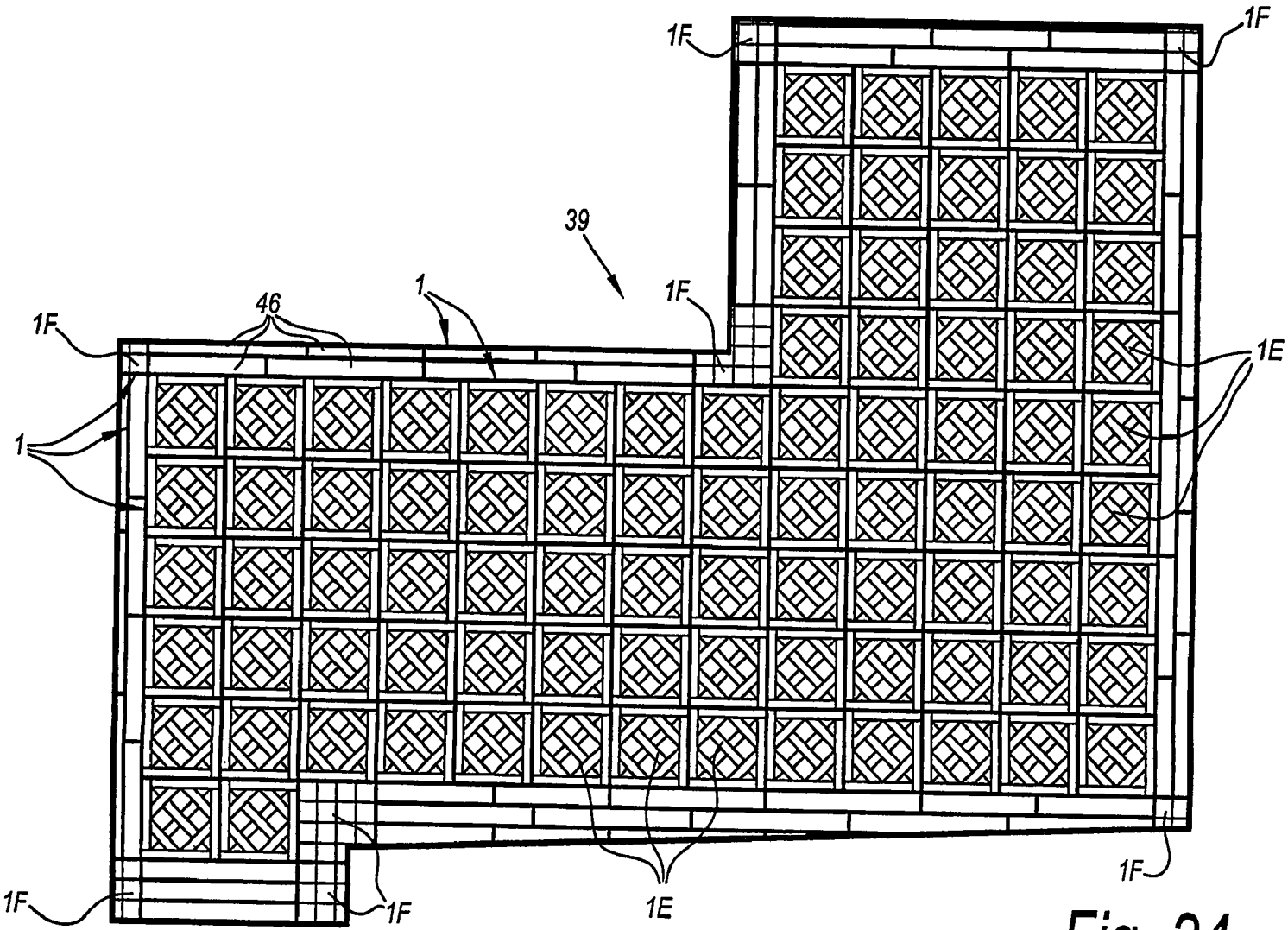

FIG. 22 shows a variant, wherein in the corners edge finishing profiles 1F, as in FIG. 21, are applied, which are sawn to size, whereas in between small strip-shaped edge finishing panels 46 are applied. FIG. 23 shows a view of the portion F23 of FIG. 22, for a variant, in which exclusively small strip-shaped edge finishing panels 46 are applied. FIG. 24 shows still a further variant which speaks for itself.

Figure 25:
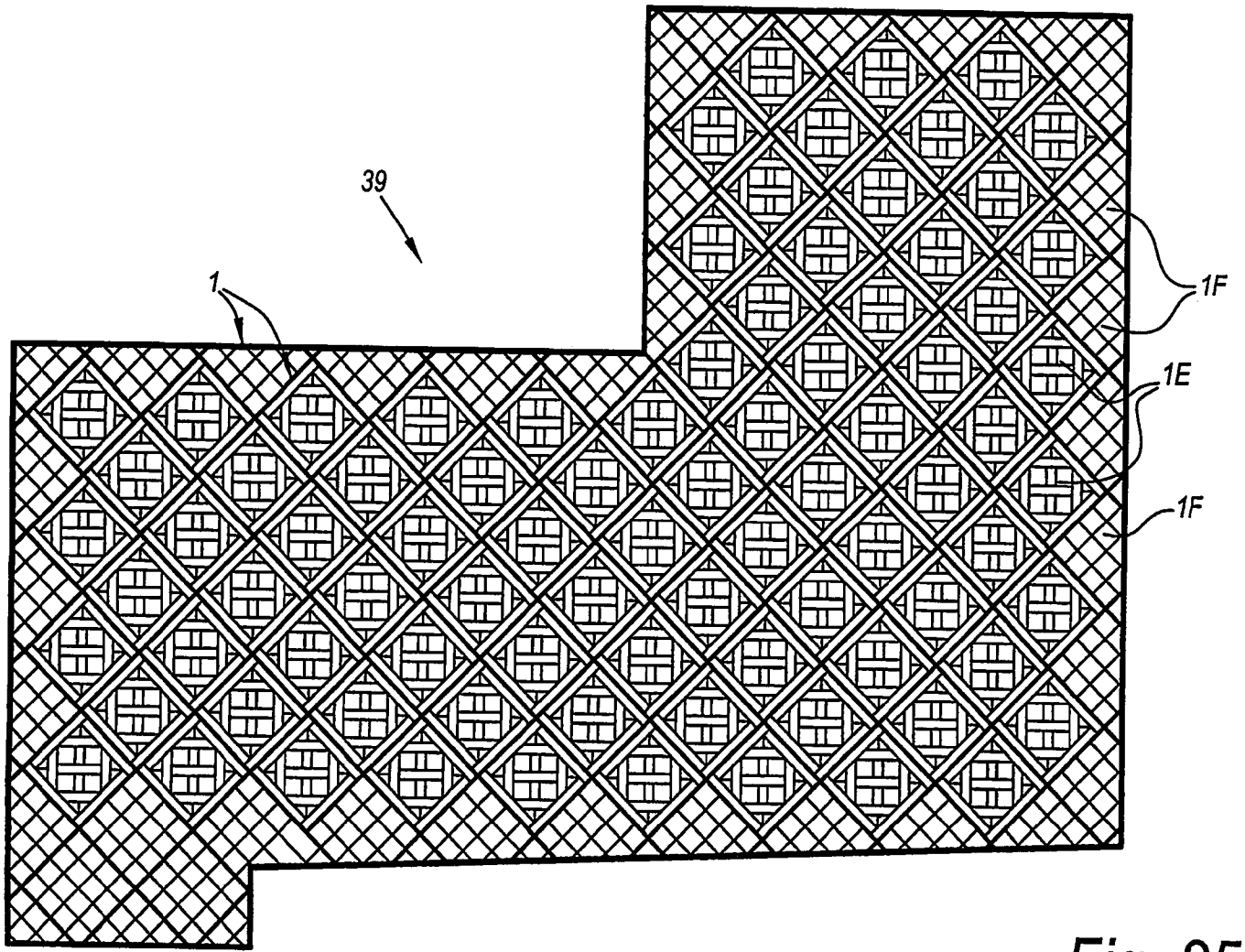

FIG. 25 shows how the aforementioned floor panels 1E and 1F can be applied in a diagonal pattern.

Figure 26:
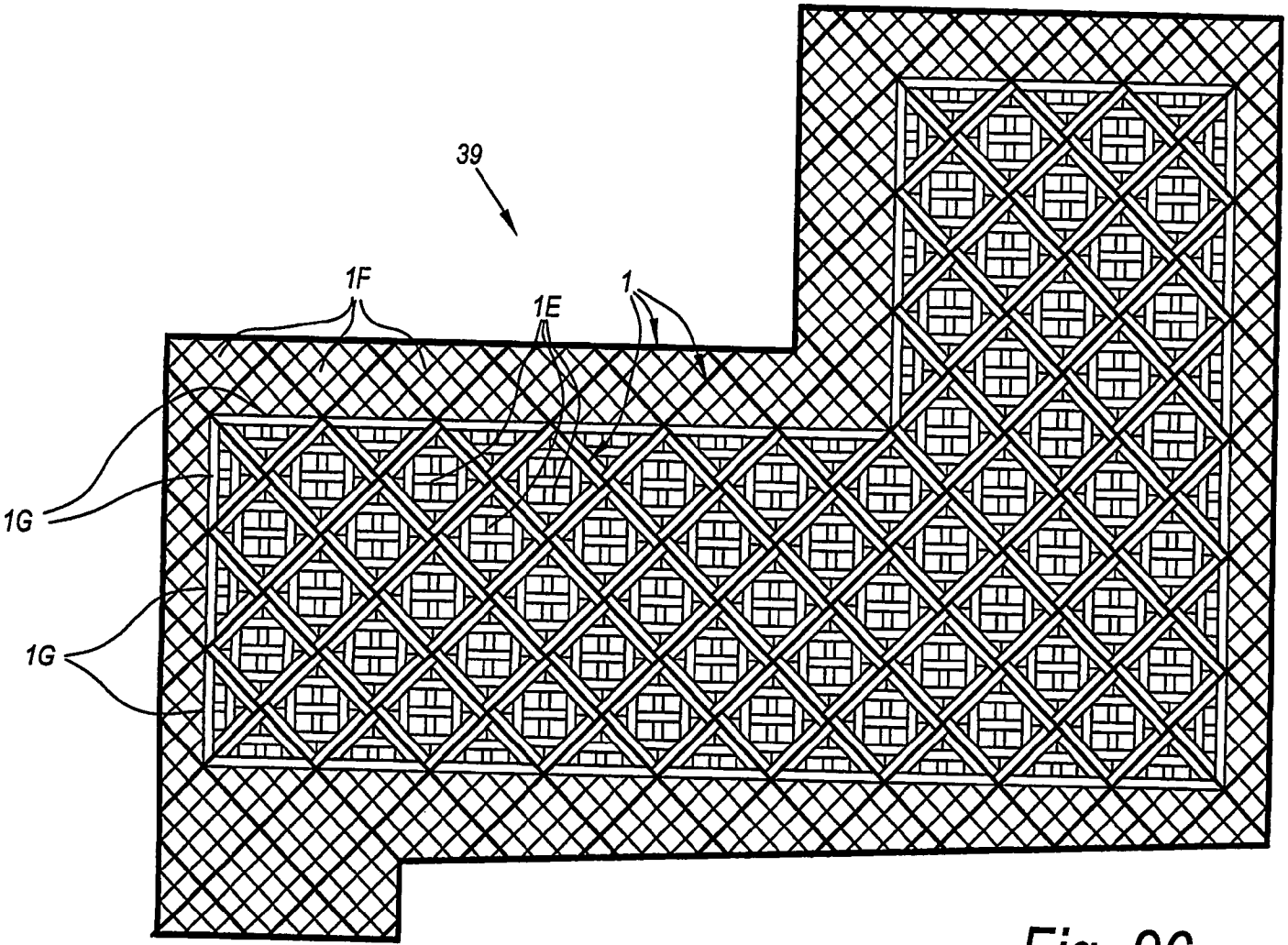
Figure 27:
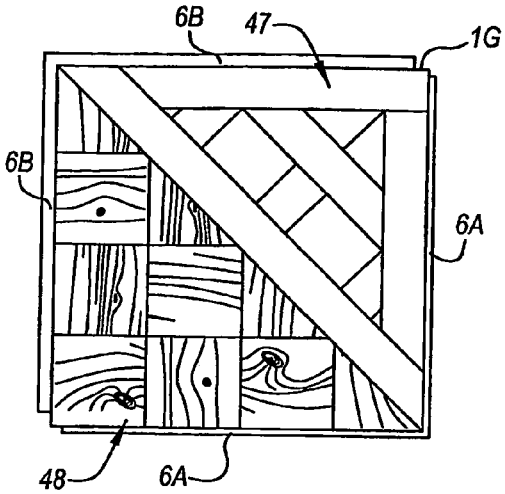
Figure 28:
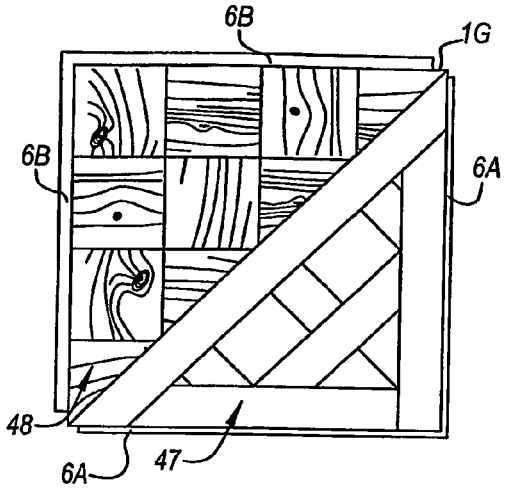
Figure 29:
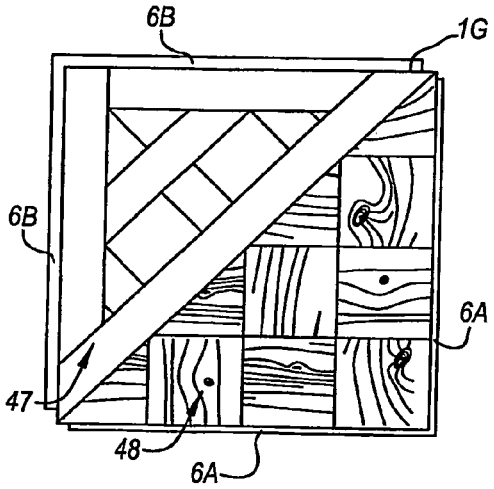
Figure 30:
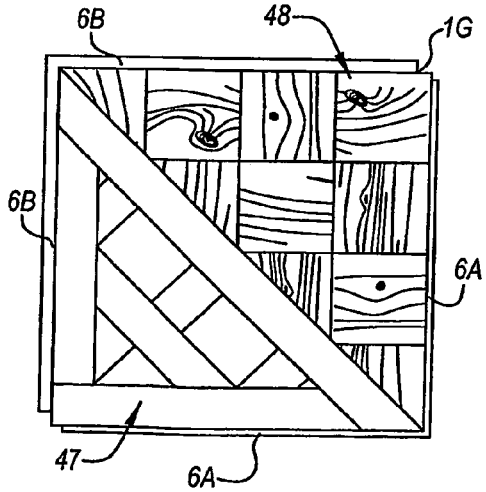

FIG. 26 shows a floor covering possessing edge finishing panels 1G, the surface of which, as is visible in FIGS. 27 to 30, is diagonally divided into two parts, of which a first part 47 has a pattern that is made in a similar manner as a parquet tile, and a second part 48 has an edge finishing pattern. Apart thereof, also floor panels 1F, as described above, are applied. In order to be able to always provide for a coupling at all sides, four different edge finishing panels 1G are required, with complementary coupling means 6A and 6B, which respectively are provided around the periphery, in a manner as depicted in FIGS. 27 to 30.

It is evident that the invention also relates to the edge finishing panels themselves. Of course, the edge finishing pattern can have any appearance, however, of course it is indeed differing from the pattern represented by the parquet tile. By making use of such edge finishing panels, it is excluded that the floor panels representing the parquet tiles must be sawn, whereby in this manner a disturbing effect is avoided because then one or more of the parquet tile patterns would have to be cut through. Preferably, the edge finishing pattern thus is chosen such that it has a more neutral appearance and the cutting thereof at the edges is hardly disturbing. Possibly, the edge finishing panels may represent a so-called frieze.

The "parquet tile pattern" according to the fourth aspect preferably is a pattern representing a tile that is composed of wood parts in the form of a frame with wood parts arranged therein, such as the pattern of a Versailles tile.

It is evident that the invention is not limited to laminate floor panels with a top layer consisting of two layers, more particularly the decor layer 11 and the overlay 12. So, for example, it may also be applied with laminate floor panels having a top layer with solely one composing layer, for example, in the case that corundum particles are integrated in the decor layer and thus no separate overlay is used. Also, the technique of the invention is possible with floor panels where the decor is printed directly on a substrate and where as a top layer a varnish or the like has been provided over the decor, in which then, for example, the respective impressions are formed. All deformations and impressions in the upper surface of the floor panels do not have to be limited to the thickness of the layer of synthetic material, by which is meant that the deformations may also continue up into underlying layers, such as the substrate 7.

The present invention is in no way limited to the forms of embodiment described as an example and represented in the figures, on the contrary may such floor panels, floor covering, as well as the method for manufacturing the floor panels, be realized according to various variants, without exceeding the scope of the invention. It is evident that all aforementioned aspects, each in its turn as well as in any mutual combination, may be applied in a real product, this latter inasmuch as such combination does not imply any contradictory characteristics.

The invention claimed is:

1. Floor panel comprising:

an upper surface located on a generally planar surface of a substrate, the upper surface having a decor layer bearing a printed decor and a top layer based on synthetic material with a transparent portion overlying said decor layer, the substrate being formed from fiberboard and having opposed generally parallel surfaces;

said decor having an appearance of a pattern with a plurality of adjacent wood parts; and wherein in the upper surface of the floor panel one or more height differences are provided in that the upper surface of the floor panel defines first and second individualized global surface levels at the locations of a first one and a second one of said plurality of adjacent wood parts, respectively;

wherein the first and second individualized global surface levels are different from one another and extend over a substantial area of said first one and said second one of said plurality of adjacent wood parts, respectively;

wherein the decor layer includes a carrier sheet upon which the decor is printed, and the carrier sheet is substantially parallel to the substrate whereas the height differences of the first and second individualized global surface levels extend exclusively in said transparent portion overlying said decor layer;

wherein the first and second individualized global surfaces are delimited by gaps and impressions formed in the top layer and located along the periphery of the adjacent wood parts of the decor pattern.

2. The floor panel according to claim 1, wherein at the location of each wood part an individualized global surface level is provided.

3. The floor panel according to claim 1 or 2, wherein at the location of a respective represented wood part the individualized global surface level is defined by at least one of:

the respective surface as a whole is disposed higher or lower than the surface at the location of one or more adjacent represented wood parts;

the respective surface is at least partially inclined in respect to the general upper surface of the floor panel;

the respective surface has a curvature;

the respective surface, in the direction of an edge or corner, is made deeper in a sloping manner with respect to the adjacent surface.

4. The floor panel according to claim 1 or 2, wherein in the upper surface of the floor panel moreover local impressions are provided having at least one of the following features:

the impressions represent wood pores;

the impressions represent either or both grooves and gaps between the wood parts;

the impressions represent either or both grooves and gaps between the wood parts, with the impressions varying in width;

the impressions represent cracks or ruptures;

the impressions represent worn-off portions;

the impressions represent wood pores or other local unevennesses, wherein said last-recited impressions are interrupted so they imitate scratches.

5. The floor panel according to claim 1 or 2, wherein the pattern represents a multiplank, wherein the represented wood parts extend over the upper surface of the floor panel with their longitudinal directions substantially parallel to each other.

6. The floor panel according to claim 1 or 2, wherein the pattern represents a parquet tile, wherein the represented wood parts extend with their longitudinal directions over the upper surface of the floor panel in at least two different directions.

7. The floor panel according to claim 6, wherein the pattern represents a Versailles tile.

8. The floor panel according to claim 1 or 2, wherein the height differences in the upper surface that determine the individualized global surface levels are formed as impressions in the top layer.

9. The floor panel according to claim 1, wherein when two of said floor panel are coupled to one another, the two floor panels define a general plane along an uppermost of the upper surface among the first and second individualized surfaces, and a degree to which the first and second individualized surfaces drop below the general plane is less than the thickness of the top layer.

10. The floor panel according to claim 1, wherein the first and second wood parts of the decor are arranged obliquely or perpendicular relative to one another, the first and second individualized global surfaces correspond to the first and second wood parts.

11. Floor covering comprising:

an upper surface and comprising a plurality of adjacent floor panels, each floor panel comprising a decor layer bearing a printed decor and a top layer based on synthetic material with a transparent portion overlying said decor layer, the decor layer located over a generally planar surface of a substrate being formed from fiberboard and having opposed generally parallel surfaces, the floor panels, at least at two opposite edges, being provided with mechanical coupling parts enabling coupling between two of the floor panels to each other at said edges, such that in a coupled condition a locking in horizontal direction perpendicular to the respective edges as well as in vertical direction is obtained, wherein in the upper surface of the floor covering has a plurality of height differences, said height differences being obtained at the location of one or more of the floor panels by an individualized global surface level;

wherein said individualized global surface level extends substantially over the upper surface of an individual floor panel;

wherein the upper surface of the floor panel defines first and second individualized global surface levels at the locations of a first one and a second one of said adjacent floor panels, respectively;

wherein the first and second individualized global surface levels are different from one another and extend over a substantial area of said first one and said second one of said plurality of adjacent floor panels, respectively;

wherein the decor layer includes a carrier sheet upon which the decor is printed, and the carrier sheet is substantially parallel to the substrate whereas the height differences of the first and second individualized global surface levels extend exclusively in said transparent portion overlying said decor layer;

wherein each of the floor panels is provided with at least one beveled portion located at or near an edge of the floor panel, the at least one beveled portion arranged so that in the floor covering, beveled edge portions of neighboring floor panels adjoin each other at the same height.

12. The floor covering according to claim 11, wherein the decor of each floor panel appears as one stone tile, such that said individualized global surface level extends substantially over the surface of an individual floor panel.

13. The floor covering according to claim 11, wherein the individualized global surface level has at the location of a respective floor panel, the surface of the floor panel as a whole is either or both situated substantially higher or lower than the surface of one or more adjacent floor panels and is situated higher or lower than the average height of the surface of the floor covering.

14. The floor covering of claim 11 or 13, wherein the various individualized global surface levels are obtained by the floor panels having impressions that vary as a function of the desired surface level.

15. The floor covering according to claim 11, wherein the individualized global surface level has at the location of a respective floor panel, the global surface is at least partially inclined with respect to the general plane including the floor covering.

16. The floor covering according to claim 11, wherein the individualized global surface level has at the location of a respective floor panel, the global surface is curved.

17. The floor covering according to claim 11, wherein the individualized global surface level has at the location of a respective floor panel, the surface becomes deeper in a sloping manner in the direction of an edge or corner of the floor panel.

18. The floor covering according to claim 11, wherein when two of said adjacent floor panel are coupled to one another, the two floor panels define a general plane along an uppermost of the upper surface among the first and second individualized surfaces, and a degree to which the first and second individualized surfaces drop below the general plane is less than the thickness of the top layer.

19. The floor covering according to claim 11, wherein the first and second wood parts of the decor are arranged obliquely or perpendicular relative to one another, the first and second individualized global surfaces correspond to the first and second wood parts.

* * * * *